US005701556A

United States Patent [19]

Sugimoto

[11] Patent Number: 5,701,556

[45] Date of Patent: Dec. 23, 1997

[54] THERMAL FIXING DEVICE HAVING TEMPERATURE CONTROL

[75] Inventor: Katsumi Sugimoto, Kawasaki, Japan

[73] Assignee: Fujitsu Limited, Kawasaki, Japan

[21] Appl. No.: 350,633

[22] Filed: Dec. 7, 1994

[30] Foreign Application Priority Data

Jan. 31, 1994 [JP] Japan ..... 6-028877

[51] Int. Cl.[6] ..... G03G 15/20

[52] U.S. Cl. ..... 399/70; 399/330

[58] Field of Search ..... 355/282, 285, 355/289, 290; 219/216; 399/69, 70, 330

[56] References Cited

U.S. PATENT DOCUMENTS

| | | | |
|---|---|---|---|
| 4,493,984 | 1/1985 | Yamauchi | 219/216 X |
| 4,618,240 | 10/1986 | Sakurai et al. . | |
| 4,736,226 | 4/1988 | Mogi . | |
| 4,933,724 | 6/1990 | Sugimoto et al. | 355/289 |
| 5,179,263 | 1/1993 | Koh et al. | 219/216 |
| 5,300,996 | 4/1994 | Yokoyama et al. | 355/285 |
| 5,331,384 | 7/1994 | Otsuka | 355/290 |
| 5,396,318 | 3/1995 | Asada | 355/285 |
| 5,408,301 | 4/1995 | Tokishige et al. | 355/285 |
| 5,444,521 | 8/1995 | Tomoyuki et al. | 355/285 |
| 5,464,964 | 11/1995 | Okuda et al. | 219/216 X |

FOREIGN PATENT DOCUMENTS

| | | |
|---|---|---|
| 60-213977 | 10/1985 | Japan . |
| 3-89383 | 4/1991 | Japan . |

*Primary Examiner*—Robert Beatty

*Attorney, Agent, or Firm*—Armstrong, Westerman, Hattori, McLeland & Naughton

[57] ABSTRACT

A thermal fixing device for rising a temperature of a heat roller up to a designated temperature in a short time and a color image forming apparatus using this device. This thermal fixing device comprises a heat roller having a heat source and positioned on the side of a toner image on a recording medium to fix the toner image; a pressurizing member, positioned opposite to the side of the toner image on the recording medium, for pushing the recording medium against the heat roller; a temperature sensor for detecting a temperature of the heat roller; and a control circuit for controlling the heat source of the heat roller by comparing a detected temperature of the temperature sensor with a set temperature, sequentially stepwise increasing the set temperature up to the designated temperature when starting the operation of the device and, at the same time, controlling a generated energy of a plurality of heat sources to sequentially decrease the generated energy thereof. The heat roller includes an elementary tube accommodating a heat source, a rubber member provided along the periphery of the elementary tube, and a heat emission prevention member covering the ends of the tube. The temperature sensor is provided in a position for detecting a temperature of this elementary tube. The heat emission prevention member is formed with a plurality of air holes.

33 Claims, 14 Drawing Sheets

THERMAL FIXING DEVICE HAVING TEMPERATURE CONTROL

BACKGROUND OF THE INVENTION

1. Field of the Invention

The present invention relates to a thermal fixing device for thermally fixing a toner image and a color image forming apparatus using this thermal fixing device.

2. Description of the Related Art

In an image forming apparatus such as a copying machine, a printer, a facsimile, etc., a latent image forming type recording apparatus like an electrophotographic apparatus has been utilized from a demand for recording on ordinary paper. In such an image forming apparatus, an electrostatic latent image is formed on a photosensitive drum and thereafter developed, thus forming a toner image. Then, after transferring the toner image on the photosensitive drum onto a sheet, a heating process is effected thereon, thereby fixing the toner image onto the sheet.

A thermal fixing device using a heat roller has been utilized as a fixing device employed for this type of electrophotographic apparatus. Simultaneously when starting the operation of the device, a halogen lamp incorporated into the heat roller is switched on to heat up the heat roller.

A problem inherent in this type of thermal fixing unit is a timing of switching off the halogen lamp when trying to rise a normal temperature up to a high temperature (approximately 170° C.–180° C.) in a short time.

FIG. 14 is a graph of assistance in explaining the prior art.

Making the halogen lamps emit the heat with the maximum output is suitable for increasing the temperature of the thermal fixing device up to a designated temperature within the short period of time. In such a case, if a timing of switching off the halogen lamp is fast, a saturation takes place before the temperature of the fixing unit reaches a set temperature. This results in an ill-fixed state which is easy to occur.

Whereas if the timing of switching off the halogen lamp is late, the temperature of the fixing unit rises over the set temperature. As shown in FIG. 14, in the fixing unit having a set temperature of 180° C., the temperature of the heat roller temporarily increases over 200° C., resulting in an occurrence of overshoot. In this case, there is no problem in a hard roller (aluminum roller) used for monochromatic printing.

In the case of color printing, however, a soft roller (rubber roller) is employed. The reason for this is that a thickness of a toner layer is large, and, consequently, the sheet becomes rugged. If the sheet is rugged, the ill-fixed state is easy to occur. As a result, a color mixture alters. For this reason, the soft roller exhibiting a good adhesion to the sheet is employed.

When using this soft roller, and if the above-mentioned overshoot is caused, an interface of the rubber material of the roller is easy to break. There is needed a technique of preventing the overshoot and causing a rise-up in a short time.

As a prior art technique of preventing this overshoot, a method in which two set temperature are prepared is disclosed in Japanese Patent Laid-Open Publication No. 60-213977. According to this method, when the temperature of the heat roller reaches a first set temperature, the heating is stopped for a given time. Thereafter, the temperature is changed to a second set temperature, and heating control is carried out, thereby preventing the overshoot.

Further, a temperature sensor for preventing this overshoot is disposed in the central position of the roller.

Based on the method having the two set temperatures, however, a generated energy of the heat source is fixed, and, therefore, the overshoot is easy to occur. Further, for getting a rise-up to the set temperature, the above-stated stopping time is required, and, hence, the rise-up is hard to attain in the short time.

Also, the heat roller is, generally, supplied with an offset preventive oil. The oil permeates in between the heat roller and the temperature sensor, and consequently the temperature of the heat roller can not be accurately detected. The rising time is therefore further delayed.

SUMMARY OF THE INVENTION

Accordingly, it is a primary object of the present invention to provide a thermal fixing device and a color image forming apparatus which serve to prevent an overshoot when rising a temperature of a heat roller.

It is another object of the present invention to provide a thermal fixing device and a color image forming apparatus which serve to rise a temperature of a heat roller up to a designated temperature in a short time.

It is still another object of the present invention to provide a thermal fixing device and a color image forming apparatus which serve to precisely detect a temperature of a heat roller.

To accomplish the above objects, according to one aspect of the thermal fixing device of the present invention, there is provided a thermal fixing device for thermally fixing a toner image on a recording medium, comprising: a heat roller having a heat source and positioned on the side of the toner image on the recording medium in order to fix the toner image; a pressurizing member, positioned opposite to the side of the toner image on the recording medium, for pushing the recording medium against the heat roller; a temperature detecting element for detecting a temperature of the heat roller; and a control circuit for controlling the heat source of the heat roller by comparing a detected temperature of the temperature detecting element with a set temperature, sequentially stepwise increasing the set temperature up to a designated temperature when starting the operation of the device and, at the same time, controlling a generated energy of the heat source to sequentially decrease the generated energy thereof.

According to one aspect of the color image forming apparatus of the present invention, there is provided a color image forming apparatus for forming a color toner image on a recording medium and thermally fixing the color toner image, the apparatus comprising: a toner image forming unit for forming the color toner image on the recording medium; a heat roller including a heat source and positioned on the side of the toner image on the recording medium to fix the toner image; a pressurizing member, positioned opposite to the side of the toner image on the recording medium, for pushing the recording medium against the heat roller; a temperature detecting element for detecting a temperature of the heat roller; and a control circuit for controlling the heat source of the heat roller by comparing a detected temperature of the temperature detecting element with a set temperature, sequentially stepwise increasing the set temperature up to a designated temperature when starting the operation of the apparatus and, at the same time, controlling a generated energy of the heat source to sequentially decrease the generated energy thereof.

According to another aspect of the thermal fixing device of the present invention, there is provided a thermal fixing device for thermally fixing a toner image on a recording medium, comprising: a heat roller including a heat source, an elementary tube provided along the periphery of the heat source and a rubber member provided on the elementary tube, the heat roller being positioned on the side of the toner image on the recording medium in order to fix the toner image; a pressurizing member, positioned opposite to the side of the toner image on the recording medium, for pushing the recording medium against the heat roller; a temperature detecting element provided in a position for detecting a temperature of the elementary tube in order to detect a temperature of the heat roller; and a control circuit for controlling the heat source of the heat roller by comparing a detected temperature of the temperature detecting element with a set temperature.

According to another aspect of the color image forming apparatus of the present invention, there is provided a color image forming apparatus for forming a color toner image on a recording medium and thermally fixing the color toner image, the apparatus comprising: a toner image forming unit for forming the color toner image on the recording medium; a heat roller including a heat source, an elementary tube provided along the periphery of the heat source and a rubber member provided on the elementary tube, the heat roller being positioned on the side of the toner image on the recording medium in order to fix the toner image; a pressurizing member, positioned opposite to the side of the toner image on the recording medium, for pushing the recording medium against the heat roller; a temperature detecting element provided in a position for detecting a temperature of the elementary tube in order to detect a temperature of the heat roller; and a control circuit for controlling the heat source of the heat roller by comparing a detected temperature of the temperature detecting element with a set temperature.

According to one aspect of the present invention, the control circuit, when sequentially stepwise increasing the set temperature, controls the generated energy of the heat source to sequentially decrease the generated energy thereof, and, therefore, the overshoot can be prevented to a greater degree than before. Further, since the heating-control of the heat source is not interrupted, the temperature is allowed to reach the set temperature in the short time.

According to another aspect of the present invention, the temperature detecting element is provided in an area of the heat roller, to which the oil is not adhered, and a temperature detection error due to the inbetween oil can be therefore prevented. Hence, the rise-up of the temperature of the heat roller is controllable more accurately.

Other features and advantages of the present invention will become readily apparent from the following description taken in conjunction with the accompanying drawings.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principle of the invention, in which.

DETAILED DESCRIPTION OF THE PREFERRED EMBODIMENTS

Figure 1A:
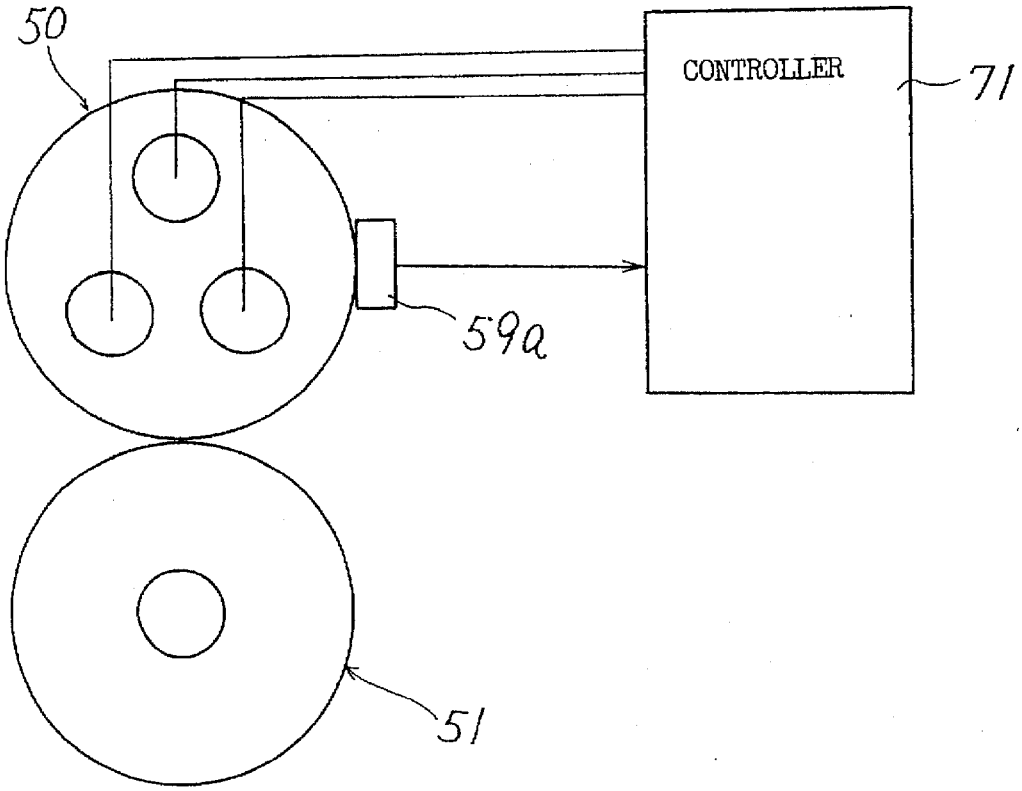
FIGS. 1A and 1B are diagrams showing the principle of the present invention.
Figure 1B:
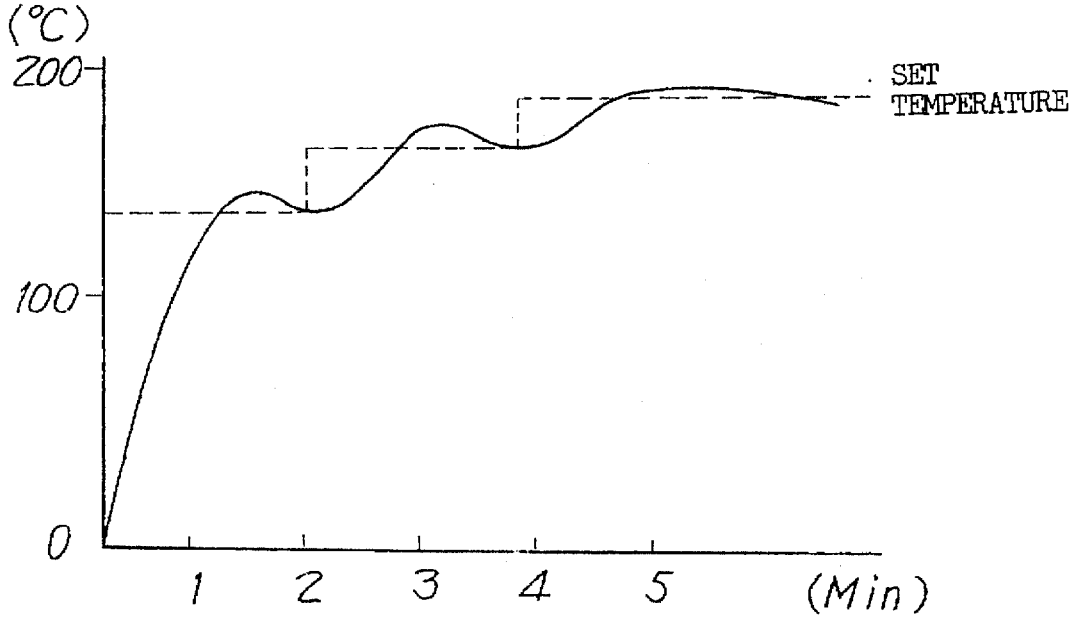

FIGS. 1A and 1B are diagrams showing the principle of the present invention.

As illustrated in FIG. 1A, a thermal fixing device includes a heat roller 50 having a heat source, a pressurizing roller 51, a temperature sensor 59*a* for detecting a temperature of the heat roller 50 and a control circuit 71.

This control circuit 71 compares a temperature detected by the temperature sensor 59*a* with a set temperature, thereby controlling the heat source of the heat roller 50. Simultaneously, the control circuit 71, as shown in FIG. 1B, performs the control to sequentially stepwise increase the set temperature up to a designated temperature when starting the operation (i.e., a start-up operation) of the apparatus and, at the same time, sequentially reduce a generated energy of the heat source.

With this operation, as illustrated in FIG. 1B, an overshoot quantity of the temperature is decreased, and, besides, the temperature can reach the designated temperature in a short time.

Figure 2:
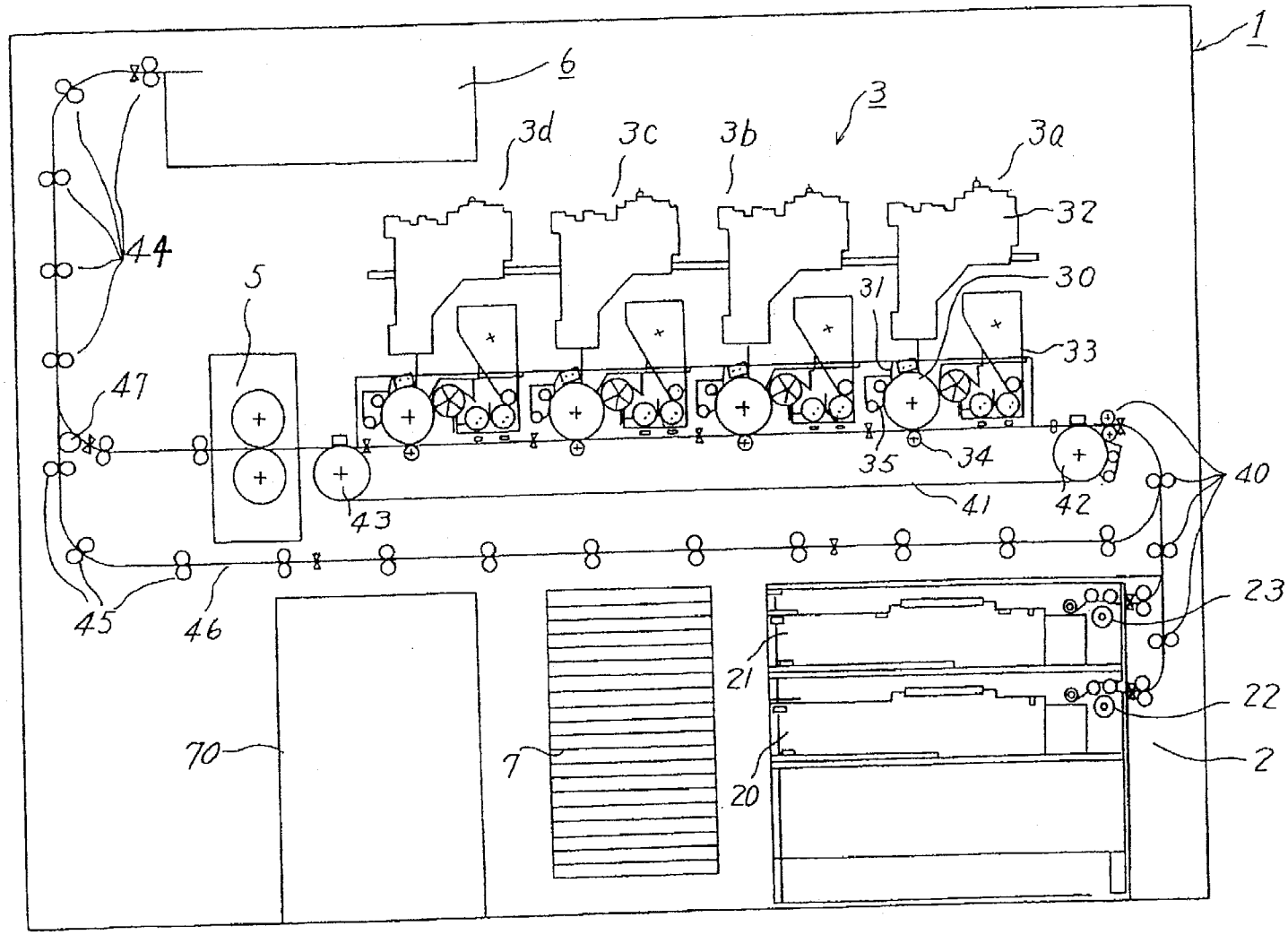
FIG. 2 is a view illustrating a construction of a color printer in one embodiment of the present invention.

FIG. 2 is a view illustrating a color image forming apparatus in one embodiment of the present invention. In accordance with this embodiment, the color image forming apparatus is illustrated in the form of a color electrophotographic printer.

As shown in FIG. 2, a color electrophotographic printer 1 includes a hopper 2 for housing sheets and a toner image forming unit 3 for forming a toner image on one surface of the sheet. The color electrophotographic printer 1 also includes a sheet feeding system 4, a thermal fixing unit 5 for fixing the toner image on the sheet, a stacker 6 for stacking the sheets discharged, a control circuit 7 and a power supply 70.

The hopper 2 has two stages of sheet cassettes 20, 21. These sheet cassettes 20, 21 are attachable and detachable from the front surface of the apparatus. Pickup units 22, 23 take out the sheet from these sheet cassettes 20, 21 and then separate the sheets.

The toner image forming unit 3 includes electrophotographic mechanisms 3*a*, 3*b*, 3*c*, 3*d* for forming toner images in full colors, i.e., magenta, yellow, cyan and black.

Each of the electrophotographic mechanisms 3*a*, 3*b*, 3*c*, 3*d* has components designated by the numerals 30–35. A photosensitive drum 30 is constructed of a metal drum coated with a photoconductive layer and rotated clockwise. A pre-charger 31 uniformly charges the photosensitive drum 30. A laser optical system 32 works to expose a photo image on the photosensitive drum 30, thereby forming an electrostatic latent image on the photosensitive drum 30. A developing unit 33 supplies the photosensitive drum 30 with a developer, and the electrostatic latent image is developed by the developer, thus forming a toner image. A transfer roller 34 serves to transfer the toner image on the photosensitive drum 30 onto a sheet fed. A deelectrifier and a cleaner 35 work to remove residual electric charges on the photosensitive drum 30 and, thereafter, clean off the residual toners.

Note that the developing unit 33 of each of the electrophotographic mechanisms 3*a*, 3*b*, 3*c*, 3*d* accommodates developers assuming colors such as magenta, yellow, cyan and black and supplies the photosensitive drum 30 with these developers.

Feed rollers 40 of the sheet feeding system feed the sheets from the sheet cassettes 20, 21 to an entrance of the toner image forming unit 3. Provided also is a belt feed mechanism 41, 42, 43 for feeding the sheets from the entrance of the image forming unit 3 to an exit. This belt feed mechanism is constructed in such a way that an electrostatic adsorption belt 41 is stretched between a pair of rollers 42, 43. The electrostatic adsorption belt 41 moved by the rollers 42, 43 feed the sheet from the entrance of the toner image forming unit 3 to the exit. A positional deviation of the sheet can be restrained down to the minimum in a transfer position of each of the electrophotographic mechanisms 3*a*, 3*b*, 3*c*, 3*d* by use of this electrostatic adsorption belt 41.

Also, in the sheet feeding system 4, discharge rollers 44 for feeding the sheet from the fixing unit 5 to the stacker 6 are disposed posterior to the fixing unit 5. Further, a mechanism for double-side printing is provided. That is, a reverse path 46 for feeding the sheets is formed extending from the posterior of the fixing unit 5 to the entrance of the toner image forming unit 3. A multiplicity of feed rollers 45 are provided in this reverse path 46. Further, a reverse impeller 47 is disposed behind the fixing unit 5.

The operation of this printer will be explained. The sheets are sent out by the pick mechanisms 22, 23 from the sheet cassettes 20, 21 and thereafter fed to the entrance of the image forming unit 3. These sheets are fed by the belt feed mechanism 41, 42, 43 to each of the electrophotographic mechanisms 3*a*, 3*b*, 3*c*, 3*d*. Meanwhile, the transfer rollers 34 transfer the toner image, assuming each color, on the photosensitive drum 30 of each of the electrophotographic mechanisms 3*a*, 3*b*, 3*c*, 3*d* onto one surface of the sheet. Then, the sheet is fed to the thermal fixing unit 5, wherein the toner image is thermally fixed. The fixed sheet is fed toward the stacker 6 by the discharge rollers 44.

In the case of effecting the double-side printing, when the trailing edge of the sheet reaches the reverse impeller 47, the sheet ceases to be fed. Then, the reverse impeller 47 is rotated counterclockwise, thereby directing the trailing edge of the sheet toward the reverse path 46. Subsequently, the discharge rollers 44 are reversely rotated, and the feed rollers 45 are also rotated, thereby feeding the sheet along the reverse path 46 toward the entrance of the toner image forming unit 3. The sheet reaching the entrance of the toner image forming unit 3 is, as in the same way with the above-mentioned one-side printing, fed by the belt feed mechanism 41, 42, 43 to each of the electrophotographic mechanisms 3*a*, 3*b*, 3*c*, 3*d*. Meanwhile, the transfer rollers 34 transfer the toner image, assuming each color, on the photosensitive drum 30 of each of the electrophotographic mechanisms 3*a*, 3*b*, 3*c*, 3*d* onto the opposite surface of the sheet. Then, the sheet is fed to the thermal fixing unit 5, wherein the toner image is thermally fixed. The fixed sheet is fed toward the stacker 6 by the discharge rollers 44. The double-side printing is carried out in this manner.

As a matter of course, when effecting the one-side printing, after performing the printing on one side of the sheet, the sheet is discharged to the stacker 6 by the discharge rollers 44.

Based on such a construction, the sheet reverse mechanism is provided by use of a space between the hopper 2 and the toner image forming unit 3. For this reason, down-sizing of the color double-side printing apparatus can be attained. Further, the feed path 4 extending from the hopper 2 to the stacker 6 is formed in an S-shape, and, therefore, the down-sizing of the color printing apparatus can be also attained. Moreover, since the electrostatic adsorption belt 41 is employed, it is possible to form the color image exhibiting a trace of color difference between the respective colors.

Figure 3:
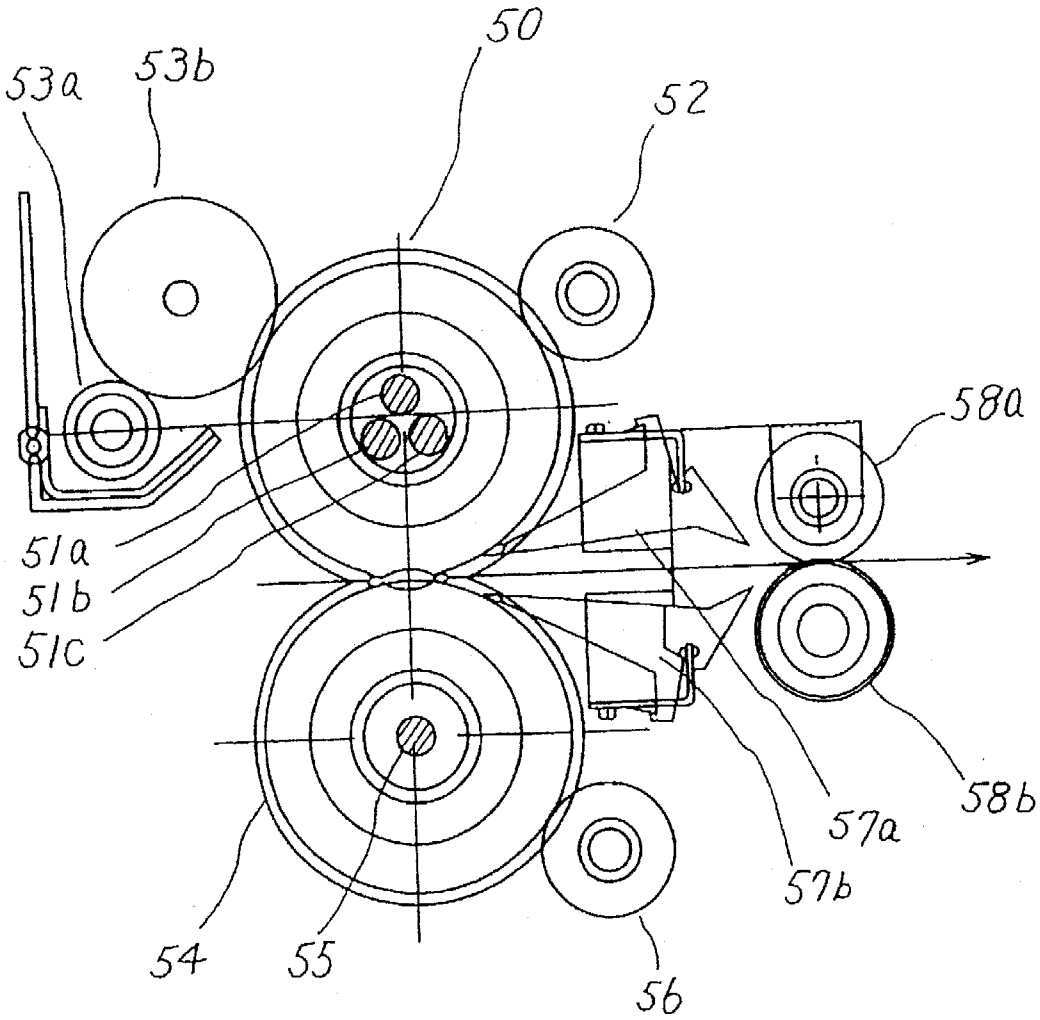
FIG. 3 is a view illustrating a configuration of a fixing unit of FIG. 2.

FIG. 3 is a view illustrating a configuration of the fixing unit in one embodiment of the present invention. Referring to FIG. 3, the sheet is fed in the right direction in the Figure irrespective of the placement of FIG. 2.

Referring again to FIG. 3, the heat roller 50 incorporates three pieces of halogen lamps 51a, 51b, 51c as a heat source (heater) in its interior. A cleaning roller 52 cleans contaminations adhered to the heat roller 50. Oil supply rollers 53*a*, 53*b* supply the heat roller 50 with an offset preventive oil (lubrication oil).

A backup roller (pressurizing roller) 54 incorporates one halogen lamp 55 serving as a heat source (heater) in its interior. This pressurizing roller 54 is pressed by the heat roller 50, and the sheet is pushed against the heat roller, thus feeding the sheet sandwiched therebetween. A cleaning roller 56 cleans the contaminations adhered to the pressurizing roller 54. Separation pawls 57*a*, 57*b* prevent the sheet from being wound on the heat roller 50 and the pressurizing roller 54, respectively. Discharge rollers 58*a*, 58*b* discharge the fixed sheet.

Figure 4:
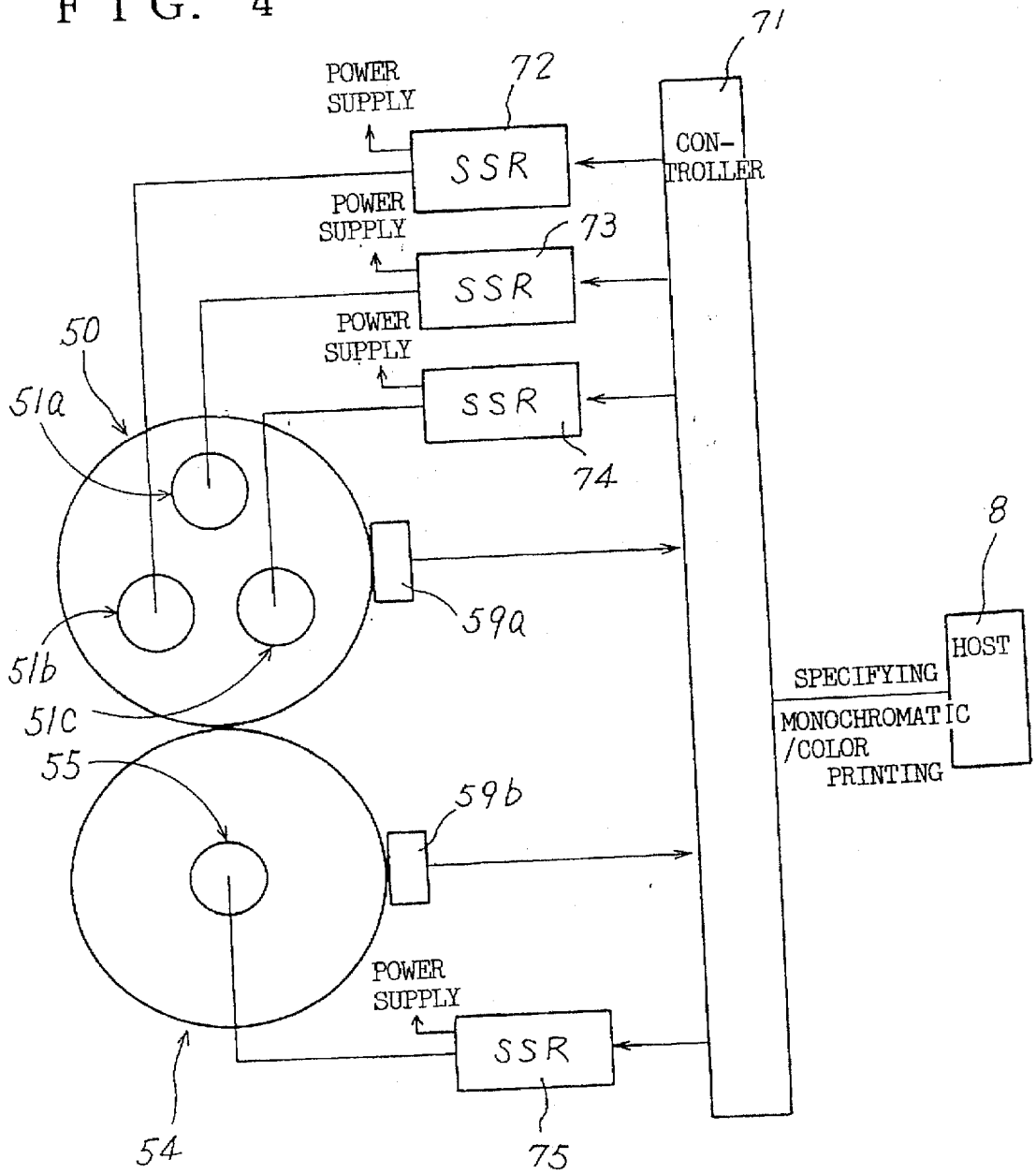
FIG. 4 is a control block diagram in one embodiment of the present invention.

FIG. 4 is a control block diagram in one embodiment of the present invention.

Turning to FIG. 4, a temperature sensor 59*a* is constructed of a thermistor. This temperature sensor 59*a* detects a temperature of the heat roller 50. A temperature sensor 59*b* is constructed of a thermistor. This temperature sensor 59*b* detects a temperature of the pressurizing roller 54. A microprocessor-based controller (control circuit) 71 controls the respective elements of the above electrophotographic mechanisms 3*a*–3*d* and, at the same time, controls the heating by the halogen lamps 51*a*–51*c* of the heat roller 50 and the halogen lamp 55 of the pressuring roller 54 of the fixing unit 5.

Set/reset switch circuits 72, 73, 74, 75 apply application voltages given from the individual power to the halogen lamps 51*a*–51*c* in accordance with indications of the controller 71. A host computer 8 gives indications about monochromatic/color printing to the controller 71 and, at the same time, transfers printing data to the controller 71.

Figure 5:
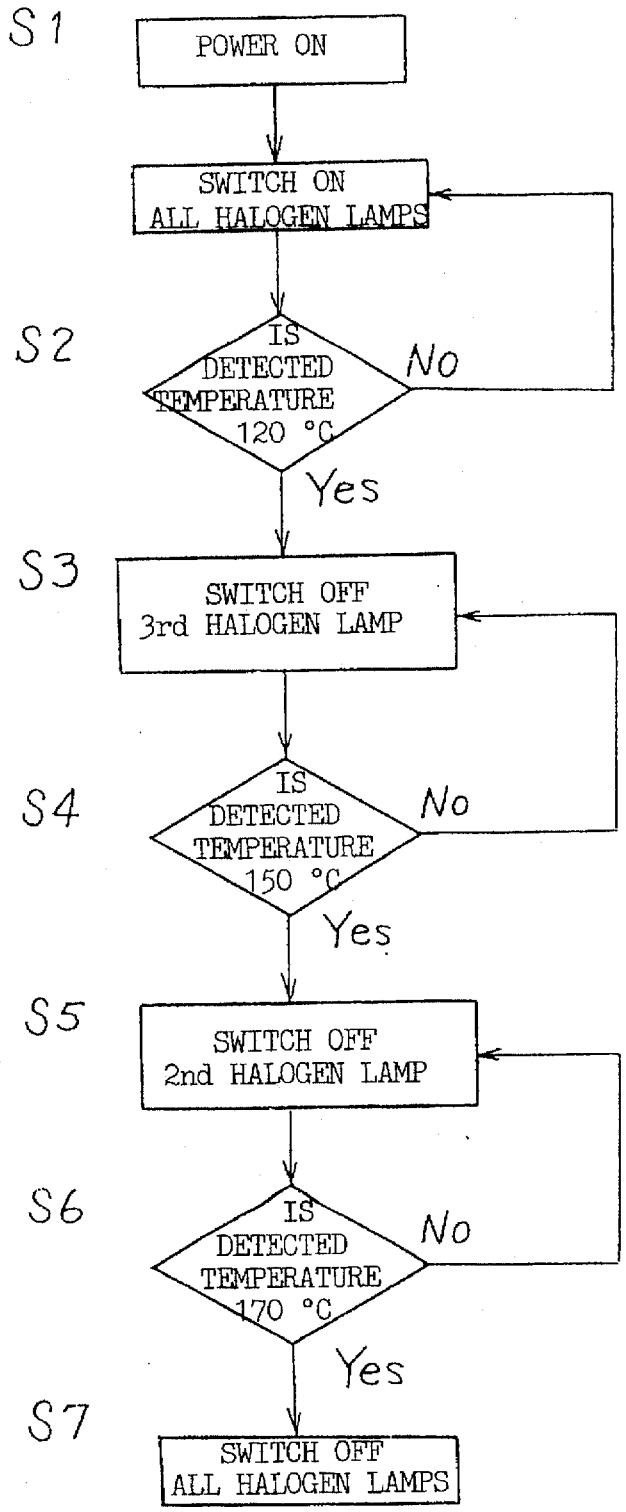
FIG. 5 is a flowchart showing start-up processing in one embodiment of the present invention.
Figure 6:
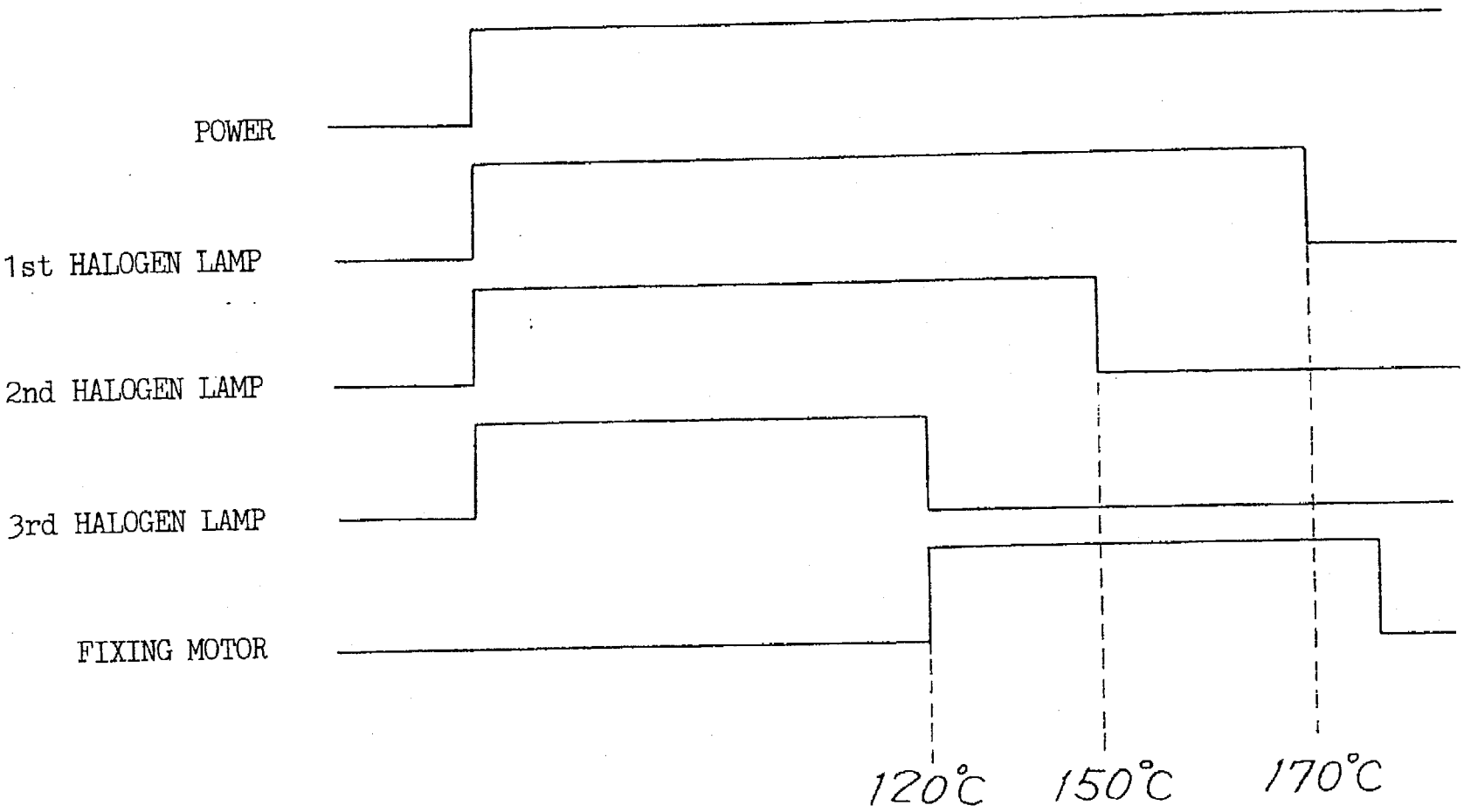
FIG. 6 is a time chart of FIG. 5.
Figure 7:
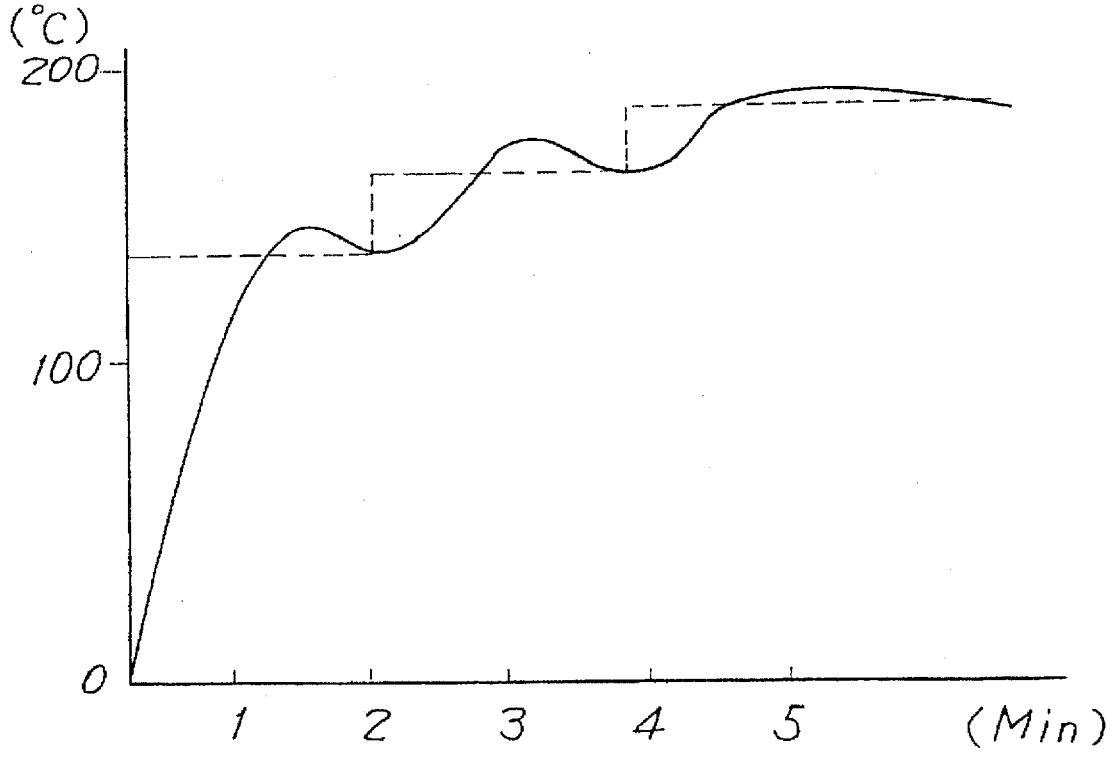
FIG. 7 is a graph of assistance in explaining the operation of FIG. 5.

FIG. 5 is a flowchart showing start-up processing according to this invention. FIG. 6 is a time chart thereof. FIG. 7 is a diagram of assistance in explaining the operation thereof.

The start-up processing (start of operation) of a heat roller fixing device will be discussed with reference to FIG. 5.

(S1) When the power supply of the apparatus is switched on, the controller 71 sets a set temperature at 120° C. Then, the controller 71 turns on the set/reset circuits 72, 73, 74 to switch on the three halogen lamps 51*a*, 51*b*, 51*c*. As illustrated in FIG. 7, the temperature is thereby increased up to the set temperature with the maximum heat power.

(S2) The controller 71 monitors a temperature detected by the temperature sensor 59*a* and determines whether or not the detected temperature reaches the set temperature.

(S3) The controller 71, when determining that the detected temperature of the temperature sensor 59*a* has reached the set temperature, switches off one of the halogen lamps 51*a*–51*c*. For example, the set-reset circuit 74 is off-controlled, thereby switching off the third halogen lamp 51*c*. With this operation, the heat power decreases. Then, the controller 71 changes the set temperature up to 150° C.

(S4) The controller 71 monitors the detected temperature of the temperature sensor 59*a* and determines whether or not the detected temperature reaches the set temperature.

(S5) The controller 71, when determining that the detected temperature of the temperature sensor 59*a* has reached the set temperature, further switches off one of the halogen lamps 51*a*–51*c*. For example, the set/reset circuit 72 is off-controlled, thereby switching off the second halogen lamp 51*b*. With this operation, the heat power further decreases. Then, the controller 71 changes the set temperature up to 170° C.

(S6) The controller 71 monitors the detected temperature of the temperature sensor 59*a* and determines whether or not the detected temperature reaches the set temperature.

(S7) The controller 71, when determining that the detected temperature of the temperature sensor 59*a* has reached the set temperature, switches off the remaining one of the halogen lamps 51*a*–51*c*. For example, the set/reset circuit 73 is off-controlled, thereby switching off the first but last lit-up halogen lamp 51*b*.

Then, after this start-up operation, and when the apparatus is brought into a ready-status, the controller 71 controls the temperature of the heat roller 50 constantly at 180° C. Further, as shown in FIG. 6, when the detected temperature comes to 120° C., an unillustrated fixing motor is rotated. With the rotations thereof, the heat roller 50 and the pressurizing roller 51 are rotated, and a thermal bias is thereby prevented. The following is an elucidation of why the rotations start when the temperature reaches 120° C. at this time. That is, if rotated when the toners adhered to the heat roller 50 and the pressurizing roller 51 are still hard, there exists a possibility in which the rollers 50, 51 are to be damaged. Accordingly, after the adhered toners are softened, the two rollers 50, 51 are rotated.

Note that the controller 71, at the same time, controls the heat of the halogen lamp 55 of the pressurizing roller 51 so that the detected temperature of the temperature sensor 59*b* comes to 140° C.

In this way, as illustrated in FIG. 7, the set temperature is, as indicated by the dotted line in the Figure, sequentially changed, and, simultaneously, the heat energy is reduced stepwise. Consequently, as shown by the solid line in the Figure, the overshoot beyond the set temperature can be made smaller than before. Further, the temperature can reach the set temperature in a short time. Moreover, a greater possibility to prevent the overshoot can be provided because of decreasing a variation width of the set temperature as changed from 120° C. to 150° C. and further from 150° C. to 170° C.; and, at the same time, the apparatus can be started up within a short period of time.

Figure 8:
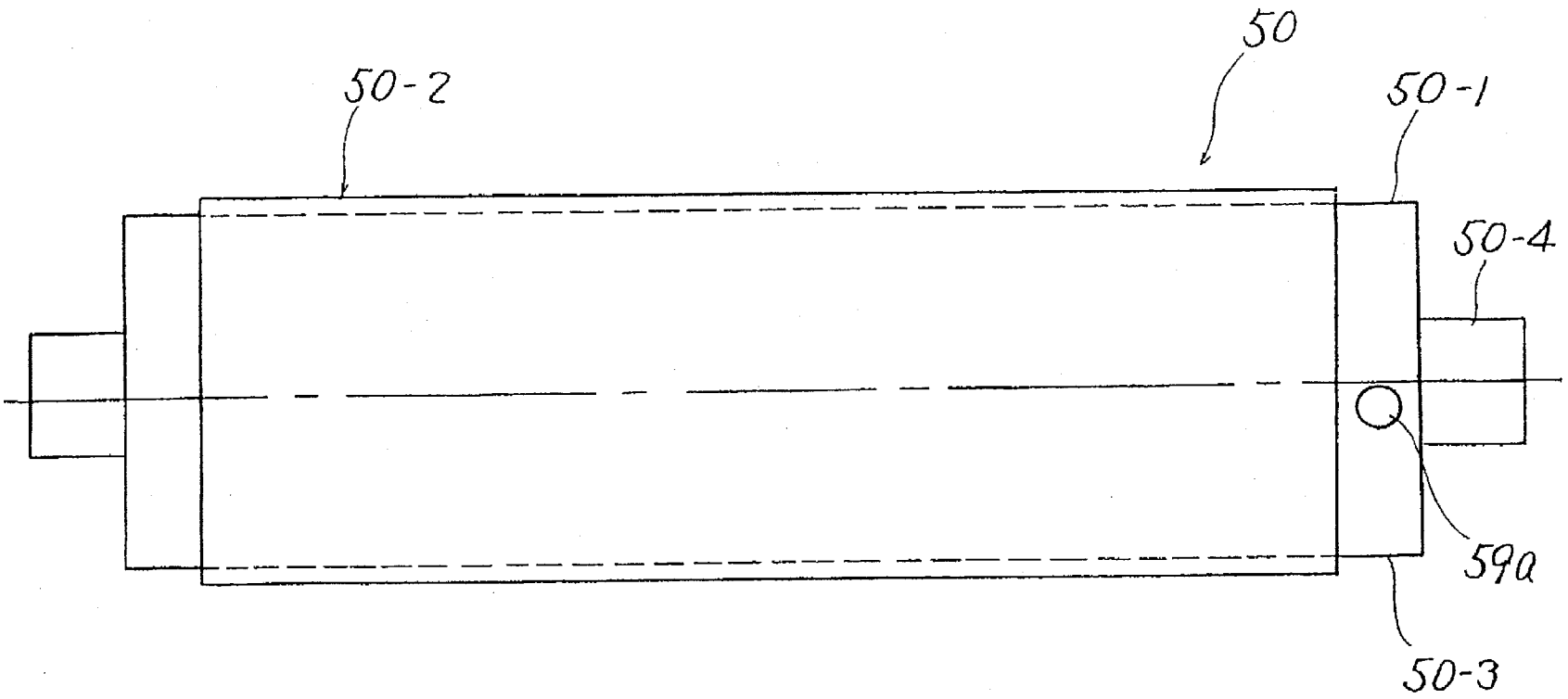
FIG. 8 is an explanatory view showing a temperature sensor mounting position according to this invention.
Figure 9:
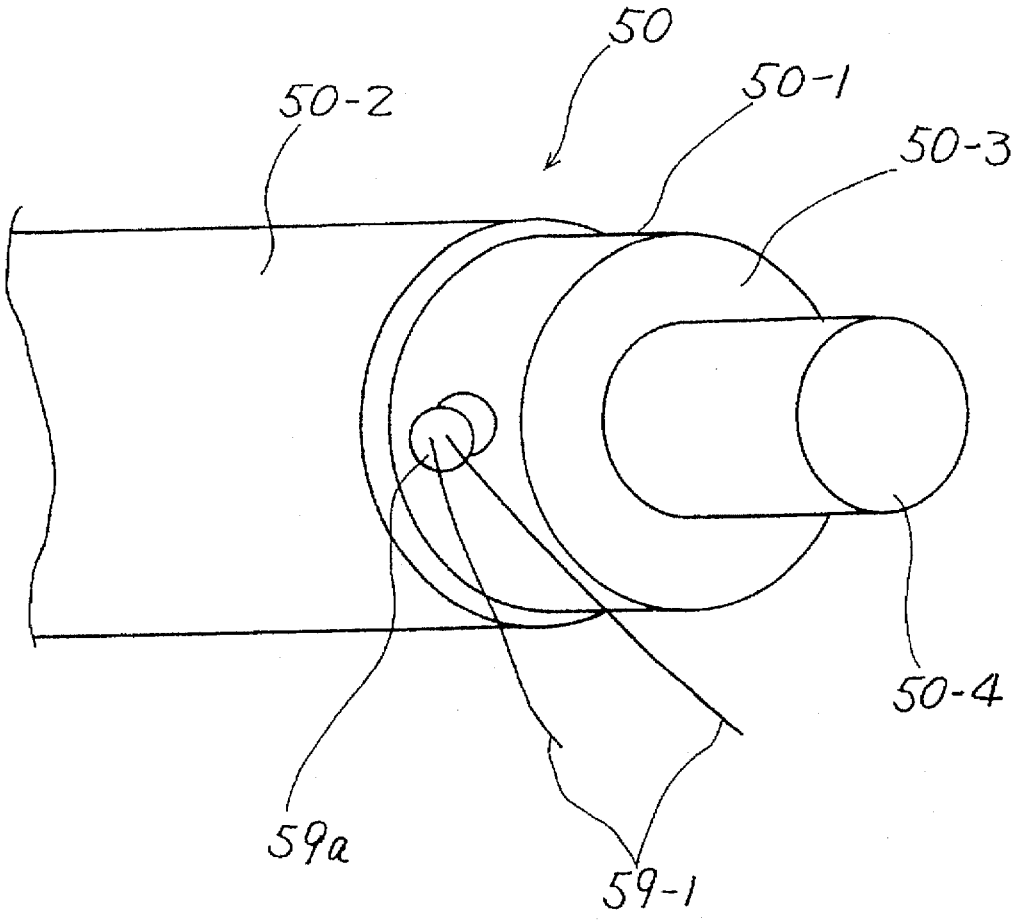
FIG. 9 is a perspective view illustrating an end portion of a heat roller of FIG. 8.

FIG. 8 is a view of assistance in explaining a mounting position of the temperature sensor according to this invention. FIG. 9 is a perspective view illustrating an end portion of the heat roller of FIG. 8.

As seen in the front view of FIG. 8 showing the heat roller, a rubber member 50-2 is provided on an elementary tube 50-1 formed in a cylindrical shape. The rubber member may be comprised of a first layer of silicon and a second layer of fluoride material. This elementary tube 50-1 is made of, e.g., aluminum. As illustrated in FIGS. 8 and 9, end portions 50-3 covered with no rubber member 50-2 are formed at both ends of this elementary tube 50-1.

In a position of this end portion 50-3, the temperature sensor 59*a* contacts the elementary tube 50-1 and thus detects a temperature of the elementary tube 50-1. Note that the temperature sensor 59*a* is fixed to a casing of the unillustrated thermal fixing device. Incidentally, the numeral 50-4 designates a rotary shaft of the elementary tube 50-1, and 59-1 represents a lead wire of the temperature sensor 59*a*.

Given hereinbelow is an elucidation of why this configuration is taken. The portion provided with the above rubber member 50-2 contacts the sheet. This rubber member 50-2 is supplied with the oil through the oil supply member 53*b* of FIG. 3 so that the toners of this sheet are not adhered (offset) to the heat roller 50.

If the temperature sensor 59*a* is provided in contact with this rubber member 50-2, the oil and the toners permeate in between the temperature sensor 59*a* and the rubber member 50-2, with the result that the temperature can not be precisely detected. For this reason, the temperature sensor 59*a* detects the temperature in the position of the end portion 50-3 of the elementary tube 50-1, to which the above oil and toners are not adhered.

Note that the pressurizing roller 51 is similarly formed with end portions covered with no rubber member at both ends of the elementary tube. Then, at these end portions, the temperature sensor 59*b* detects a temperature of the elementary tube.

If constructed in this way, the temperature can be precisely detected, and, hence, the overshoot at the above start-up can be prevented all the more. Further, when in a normal operation, the heat roll can be controlled accurately to the set temperature.

Figure 10:
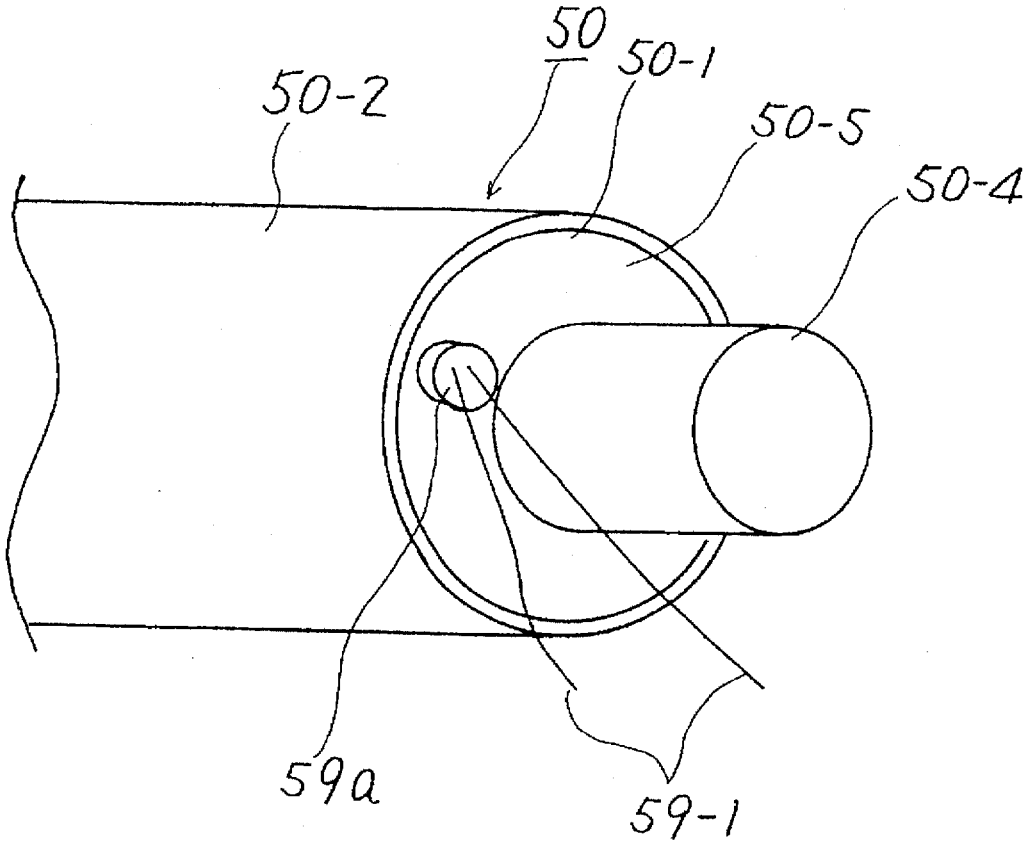
FIG. 10 is a view illustrating another temperature sensor mounting position according to this invention.

FIG. 10 is an explanatory view showing another mounting position of the temperature sensor according to this invention. Referring to FIG. 10, the same components as those shown in FIG. 9 are marked with the like numerals.

As illustrated in FIG. 10, the temperature sensor 59*a* contacts the elementary tube 50-1 of the roller 50 in a position of a side surface 50-5 of the elementary tube 50-1 of the heat roller 50 and thus detects a temperature of the heat roller 50. In this example also, the temperature sensor 59*a* detects the temperature in the position of the side surface 50-5 of the elementary tube 50-1, to which the oil and the toners are not adhered. The temperature can be therefore precisely detected.

Figure 11:
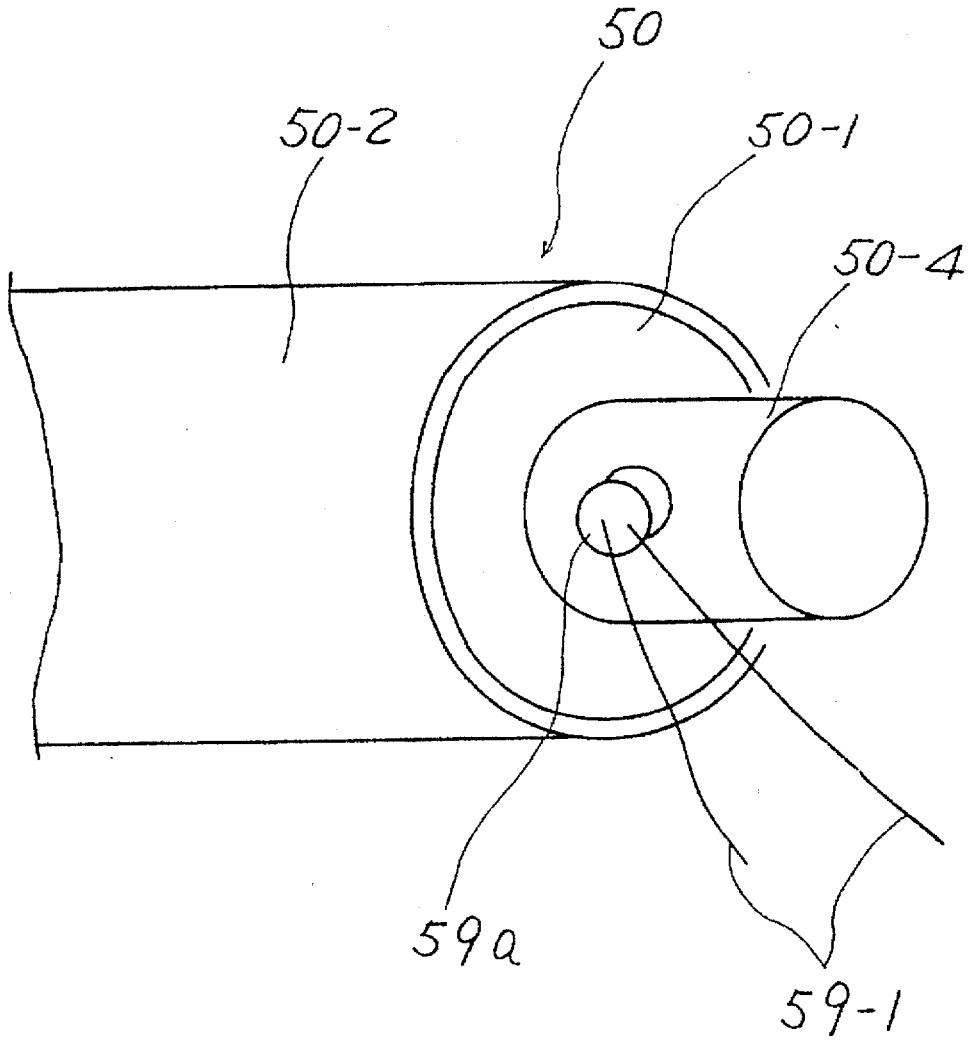
FIG. 11 is a view illustrating still another temperature sensor mounting position according to this invention.

FIG. 11 is an explanatory view showing still another mounting position of the temperature sensor according to this invention. The same components as those shown in FIG. 9 are marked with the like numerals.

As depicted in FIG. 11, the temperature sensor 59*a* contacts a shaft 50-4 of the elementary tube 50-1 of the heat roller 50 and thus detects a temperature of the heat roller 50. In this example also, the temperature sensor 59*a* detects the temperature in the position of the shaft 50-4 of the elementary tube 50-1, to which the oil and the toners are not adhered. The temperature can be therefore precisely detected.

Figure 12:
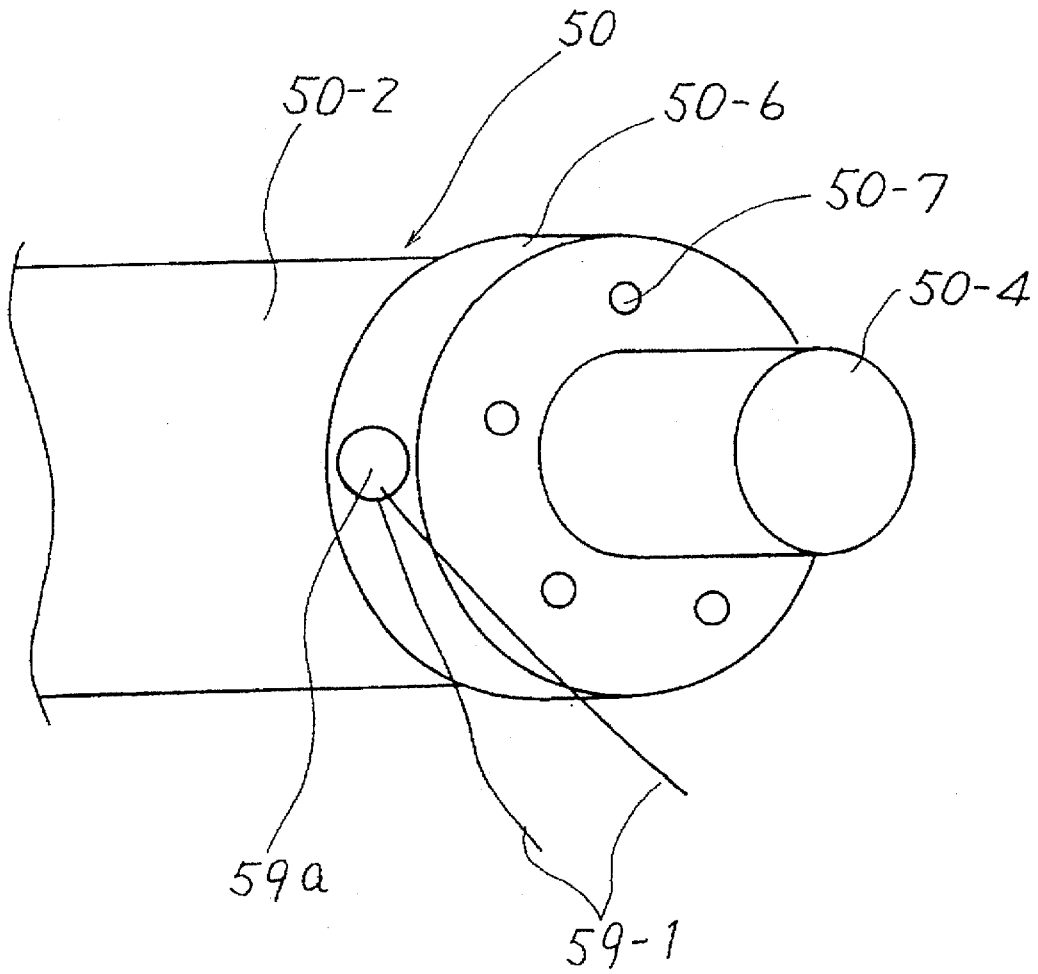
FIG. 12 is a perspective view illustrating an example of modification of the present invention.
Figure 13:
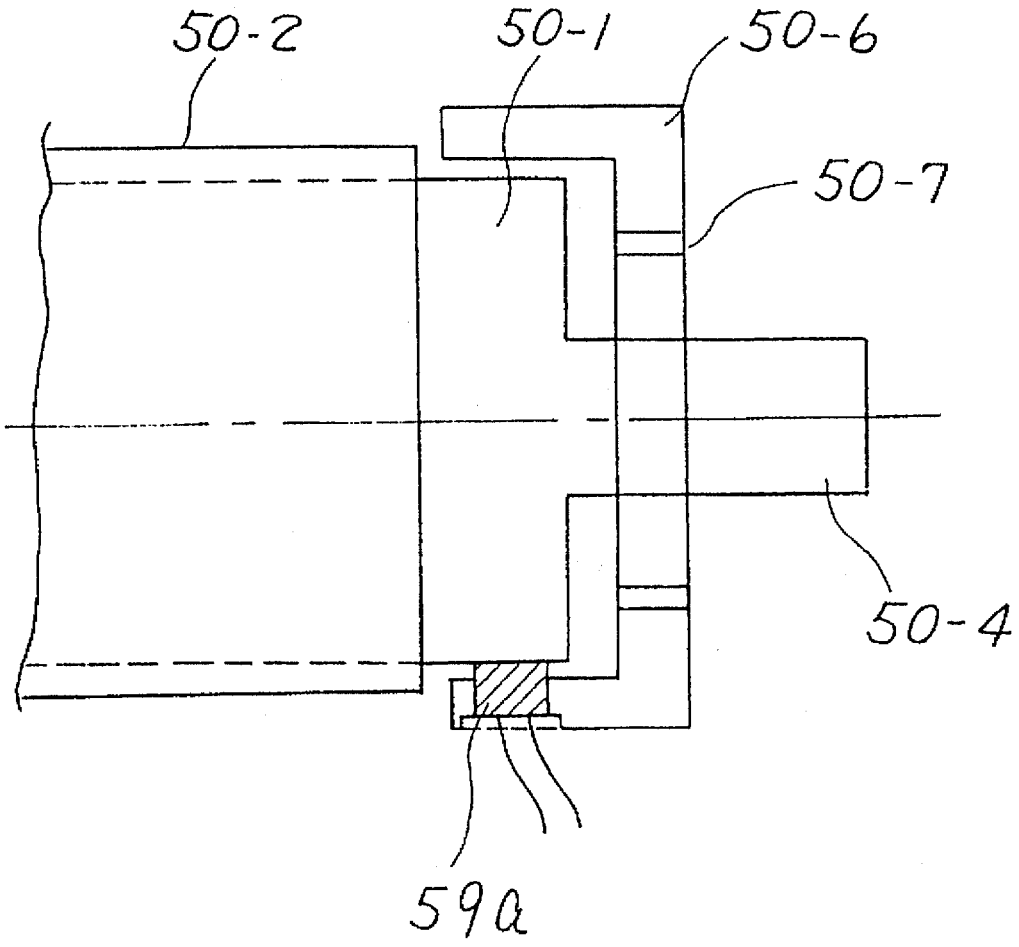
FIG. 13 is a sectional view showing the example of modification of FIG. 12.
Figure 14:
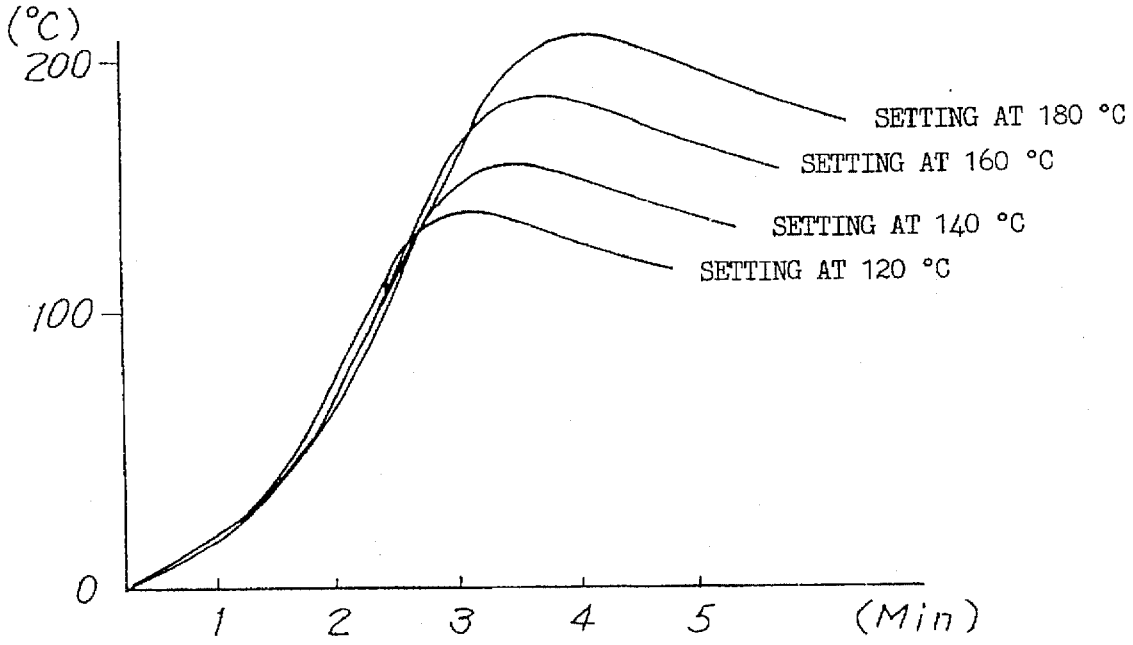
FIG. 14 PRIOR ART
FIG. 14 is a graph of assistance in explaining the prior art.

FIG. 12 is a perspective view showing an example of modification of the present invention. FIG. 13 is a sectional view thereof.

As illustrated in FIG. 12, a heat emission preventive member 50-6 is provided on the side surface of the heat roller 50. This heat emission preventive member 50-6, as illustrated in FIG. 13, serves to prevent an emission of the heat in the interior of the elementary tube 50-1 at the end portion of the elementary tube 50-1.

Herein, the temperature sensor 59*a* is attached to the heat emission preventive member 50-6. This temperature sensor 59*a* contacts the elementary tube 50-1 of the heat roller 50 and thus detects a temperature of the elementary tube 50-1. With this arrangement, it is possible to prevent emissions of the heat from both ends of the elementary tube 50-1. Drops in the temperatures at both ends of the heat roller 50 can be thereby prevented, and, therefore, the temperature of the elementary tube 50-1 can be accurately detected.

This heat emission preventive member 50-6 is formed with a plurality (five in the Figure) of air holes 50-7 through which the air in the interior of the heat roller 50 is allowed to properly flow.

The present invention may take the following modifications other than the embodiments discussed above. First, the temperature sensor involves the use of the thermistor, but other temperature sensors such as a thermocouple, etc. can be also employed. Second, the heat source has been explained by way of the halogen lamp, but other heater elements may also be used. Third, the heat source has been explained by way of three pieces of lamps, but a single piece of lamp may suffice for use. In this case, a power supply quantity is made variable, and, with this arrangement, the generated energy can be varied. Fourth, in the embodiments discussed above, the image forming apparatus has been described in the form of the electrophotographic mechanism but is usable for a printing mechanism (e.g., an electrostatic recording mechanism, etc.) for transferring the toner image. Fifth, the sheet is not confined to the paper but may involve the use of other mediums. Sixth, the image forming apparatus has been described in the form of the printer but may be other image forming apparatuses such as a copying machine, a facsimile, etc. Seventh, the transferring unit has been explained in the form of the transfer roller, but a transfer charger may also be used.

The present invention has been discussed by way of the embodiments. The present invention can be, however, modified in a variety of forms within the scope of the gist of this invention, and these modification are not eliminated from the scope of the present invention.

As discussed above, according to the present invention, the control circuit 71 sequentially reduces the generated energy of the heat source when sequentially stepwise increasing the set temperature, and, therefore, the overshoot can be prevented more than before. Further, since the heating control of the heat source is not interrupted, the temperature can reach the set temperature in the short time. Moreover, the temperature detecting element 59*a* is provided in the area of the end portion of the heat roller 50, to which the oil is not adhered, and it is therefore possible to prevent the temperature detection error due to the inbetween oil. Therefore, the start-up control of the temperature of the heat roller becomes more accurate.

What is claimed is:

1. A thermal fixing device for thermally fixing a toner image on a recording medium comprising:

a heat roller having a heat source and positioned on the side of the toner image on the recording medium in order to fix the toner image;

a pressurizing member, positioned opposite to the side of the toner image on the recording medium, for pushing the recording medium against said heat roller;

temperature detecting means for detecting a temperature of said heat roller; and a control circuit for controlling said heat source of said heat roller by comparing a detected temperature of said temperature detecting means with a set temperature, sequentially stepwise increasing the set temperature up to a designated temperature when starting the operation of said device and, at the same time, controlling a generated energy of said heat source to sequentially decrease the generated energy thereof, wherein said control circuit changes the temperature from a first set temperature to a second set temperature higher than said first set temperature and from said second set temperature to a third set temperature higher than said second set temperature, wherein the difference between said second and first set temperatures is greater than the difference between said third and second set temperatures.

2. The thermal fixing device according to claim 1, wherein said heat roller includes a single heating element, and said control circuit controls the generated energy of said heat element to sequentially decrease the generated energy.

3. The thermal fixing device of claim 1, wherein said heat roller includes a plurality of heat sources, and said control circuit controls the number of said heat sources which are operating, sequentially decreasing the number of operating heat sources to sequentially decrease the generated energy of said heat roller.

4. A thermal fixing device for thermally fixing a toner image on a recording medium comprising:

a heat roller having a heat source and positioned on the side of the toner image on the recording medium in order to fix the toner image;

a pressurizing member, positioned opposite to the side of the toner image on the recording medium, for pushing the recording medium against said heat roller;

temperature detecting means for detecting a temperature of said heat roller; and a control circuit for controlling said heat source of said heat roller by comparing a detected temperature of said temperature detecting means with a set temperature, sequentially stepwise increasing the set temperature up to a designated temperature when starting the operation of said device and, at the same time, controlling a generated energy of said heat source to sequentially decrease the generated energy thereof, wherein said heat roller includes a plurality of heat sources, and said control circuit controls the number of said heat sources for evolving the heat in order to control the generated energy of said heat source to sequentially decrease the generated energy.

5. The thermal fixing device according to claim 4, wherein said control circuit changes the temperature to a second set temperature higher than a first set temperature by detecting that the detected temperature of said temperature detecting means reaches the first set temperature and, at the same time, changes the generated energy of said heat source from a first generated energy to a second generated energy smaller than the first generated energy.

6. The thermal fixing device of claim 4, wherein said control circuit changes the temperature from a first set temperature to a second set temperature higher than said first set temperature and from said second set temperature to a third set temperature higher than said second set temperature, wherein the difference between said second and first set temperatures is greater than the difference between said third and second set temperatures.

7. A thermal fixing device for thermally fixing a toner image on a recording medium comprising:

a heat roller having a heat source and positioned on the side of the toner image on the recording medium in order to fix the toner image, said heat roller including an elementary tube accommodating said heat source and a rubber member provided along the periphery of the elementary tube;

a pressurizing member, positioned opposite to the side of the toner image on the recording medium, for pushing the recording medium against said heat roller;

temperature detecting means for detecting a temperature of said heat roller; and a control circuit for controlling said heat source of said heat roller by comparing a detected temperature of said temperature detecting means with a set temperature, sequentially stepwise increasing the set temperature up to a designated temperature when starting the operation of said device and, at the same time, controlling a generated energy of said heat source to sequentially decrease the generated energy thereof; and a heat emission preventive member formed with a plurality of air holes, covering an end portion of said elementary tube, for preventing a heat emission from the end portion of said elementary tube.

8. The thermal fixing device according to claim 7, wherein said temperature detecting means is provided in a position for detecting a temperature of said elementary tube.

9. The thermal fixing device according to claim 7, wherein said temperature detecting means is provided at such an end portion of said elementary tube that said rubber member is not provided.

10. The thermal fixing device according to claim 7, wherein said temperature detecting means is provided on a side surface of said elementary tube.

11. The thermal fixing device according to claim 7, wherein said temperature detecting means is provided on a shaft of said elementary tube.

12. The thermal fixing device of claim 7, wherein said control circuit changes the temperature from a first set temperature to a second set temperature higher than said first set temperature and from said second set temperature to a third set temperature higher than said second set temperature, wherein the difference between said second and first set temperatures is greater than the difference between said third and second set temperatures.

13. The thermal fixing device of claim 7, wherein said heat roller includes a plurality of heat sources, and said control circuit controls the number of said heat sources which are operating, sequentially decreasing the number of operating heat sources to sequentially decrease the generated energy of said heat roller.

14. A thermal fixing device for thermally fixing a toner image on a recording medium, comprising:

a heat roller including a heat source, an elementary tube provided along the periphery of said heat source and a robber member provided along the periphery of said elementary tube, said heat roller being positioned on the side of the toner image on the recording medium in order to fix the toner image;

a pressurizing member, positioned opposite to the side of the toner image on the recording medium, for pushing the recording medium against said heat roller;

temperature detecting means provided in a position for detecting a temperature of said elementary tube in order to detect a temperature of said heat roller;

a control circuit for controlling said heat source of said heat roller by comparing a detected temperature of said temperature detecting means with a set temperature; and a heat emission preventive member formed with a plurality of air holes, covering an end portion of said elementary tube, for preventing a heat emission from the end portion of said elementary tube.

15. The thermal fixing device according to claim 14, wherein said temperature detecting means is provided at said end portion of said elementary tube that said rubber member is not provided.

16. The thermal fixing device according to claim 14, wherein said temperature detecting means is provided on a side surface of said elementary tube.

17. The thermal fixing device according to claim 14, wherein said temperature detecting means is provided on a shaft of said elementary tube.

18. The thermal fixing device of claim 14, wherein said control circuit changes the temperature from a first set temperature to a second set temperature higher than said first set temperature and from said second set temperature to a third set temperature higher than said second set temperature, wherein the difference between said second and first set temperatures is greater than the difference between said third and second set temperatures.

19. The thermal fixing device of claim 14, wherein said heat roller includes a plurality of heat sources, and said control circuit controls the number of said heat sources which are operating, sequentially decreasing the number of operating heat sources to sequentially decrease the generated energy of said heat roller.

20. A color image forming apparatus for forming a color toner image on a recording medium and thermally fixing the color toner image, said apparatus comprising:

toner image forming means for forming the color toner image on the recording medium;

a heat roller including a heat source and positioned on the side of the toner image on the recording medium to fix the toner image;

a pressurizing member, positioned opposite to the side of the toner image on the recording medium, for pushing the recording medium against the heat roller;

temperature detecting means for detecting a temperature of said heat roller; and a control circuit for controlling said heat source of said heat roller by comparing a detected temperature of said temperature detecting means with a set temperature, sequentially stepwise increasing the set temperature up to a designated temperature when starting the operation of said apparatus, and at the same time, controlling a generated energy of said heat source to sequentially decrease the generated energy thereof, wherein said control circuit changes the temperature from a first set temperature to a second set temperature higher than said first set temperature and from said second set temperature to a third set temperature higher than said second set temperature, wherein the difference between said second and first set temperatures is greater than the difference between said third and second set temperatures.

21. The color image forming apparatus according to claim 20, wherein said heat roller includes a single heating element, and said control circuit control the generated energy of said heat element to sequentially decrease the generated energy.

22. The color image forming apparatus of claim 20, wherein said heat roller includes a plurality of heat sources, and said control circuit controls the number of said heat sources which are operating, sequentially decreasing the number of operating heat sources to sequentially decrease the generated energy of said heat roller.

23. A color image forming apparatus for forming a color toner image on a recording medium and thermally fixing the color toner image, said apparatus comprising:

toner image forming means for forming the color toner image on the recording medium;

a heat roller including a heat source and positioned on the side of the toner image on the recording medium to fix the toner image;

a pressurizing member, positioned opposite to the side of the toner image on the recording medium, for pushing the recording medium against the heat roller;

temperature detecting means for detecting a temperature of said heat roller; and a control circuit for controlling said heat source of said heat roller by comparing a detected temperature of said temperature detecting means with a set temperature, sequentially stepwise increasing the set temperature up to a designated temperature when starting the operation of said apparatus, and at the same time, controlling a generated energy of said heat source to sequentially decrease the generated energy thereof, wherein said heat roller includes a plurality of heat sources, and said control circuit controls the number of said heat sources for evolving the heat in order to control the generated energy of said heat source to sequentially decrease the generated energy.

24. The color image forming apparatus according to claim 23, wherein said control circuit changes the temperature to a second set temperature higher than a first set temperature by detecting that the detected temperature of said temperature detecting means reaches the first set temperature and, at the same time, changes the generated energy of said heat source from a first generated energy to a second generated energy smaller than the first generated energy.

25. The color image forming apparatus according to claim 23, wherein said heat roller includes an elementary tube accommodating said heat source and a rubber member provided along the periphery of the elementary tube.

26. The color image forming apparatus according to claim 25, wherein said temperature detecting means is provided in a position for detecting a temperature of said elementary tube.

27. The color image forming apparatus of claim 23, wherein said control circuit changes the temperature from a first set temperature to a second set temperature higher than said first set temperature and from said second set temperature to a third set temperature higher than said second set temperature, wherein the difference between said second and first set temperatures is greater than the difference between said third and second set temperatures.

28. A color image forming apparatus for forming a color toner image on a recording medium and thermally fixing the color toner image, said apparatus comprising:

toner image forming means for forming the color toner image on the recording medium;

a heat roller including a heat source, an elementary tube provided along the periphery of said heat source and a rubber member provided along the periphery of said elementary tube, said heat roller being positioned on the side of the toner image on the recording medium in order to fix the toner image;

a pressurizing member, positioned opposite to the side of the toner image on the recording medium, for pushing the recording medium against said heat roller;

temperature detecting means provided in a position for detecting a temperature of said elementary tube in order to detect a temperature of said heat roller;

a control circuit for controlling said heat source of said heat roller by comparing a detected temperature of said temperature detecting means with a set temperature; and a heat emission preventive member formed with a plurality of air holes, covering an end portion of said elementary tube, for preventing a heat emission from the end portion of said elementary tube.

29. The color image forming apparatus according to claim 28, wherein said temperature detecting means is provided at said portion of said elementary tube that said rubber member is not provided.

30. The color image forming apparatus according to claim 28, wherein said temperature detecting means is provided on a side surface of said elementary tube.

31. The color image forming apparatus according to claim 28, wherein said temperature detecting means is provided on a shaft of said elementary tube.

32. The color image forming apparatus of claim 28, wherein said control circuit changes the temperature from a first set temperature to a second set temperature higher than said first set temperature and from said second set temperature to a third set temperature higher than said second set temperature, wherein the difference between said second and first set temperatures is greater than the difference between said third and second set temperatures.

33. The color image forming apparatus of claim 28, wherein said heat roller includes a plurality of heat sources, and said control circuit controls the number of said heat sources which are operating, sequentially decreasing the number of operating heat sources to sequentially decrease the generated energy of said heat roller.

* * * * *